US006625915B1

(12) United States Patent
Friederichsen

(10) Patent No.: US 6,625,915 B1
(45) Date of Patent: Sep. 30, 2003

(54) ALBUM SHEET

(75) Inventor: Christian Friederichsen, Eschweiler (DE)

(73) Assignee: Holson GmbH, Alsdorf (DE)

( * ) Notice: Subject to any disclaimer, the term of this patent is extended or adjusted under 35 U.S.C. 154(b) by 0 days.

(21) Appl. No.: 09/341,649

(22) PCT Filed: Nov. 4, 1997

(86) PCT No.: PCT/DE97/02547

§ 371 (c)(1),
(2), (4) Date: Jul. 15, 1999

(87) PCT Pub. No.: WO98/32614

PCT Pub. Date: Jul. 30, 1998

(30) Foreign Application Priority Data

Jan. 24, 1997 (DE) ..... 197 02 474

(51) Int. Cl.[7] ..... A47G 1/06
(52) U.S. Cl. ..... 40/776; 40/765; 402/79
(58) Field of Search ..... 40/776, 530, 537, 40/124.2, 765, 775, 774, 777; 281/38; 402/79

(56) References Cited

U.S. PATENT DOCUMENTS 2,963,809 A * 12/1960 Parker
3,921,322 A * 11/1975 Sharp
5,265,359 A * 11/1993 Glazer et al.
5,529,172 A * 6/1996 Laughlin ..... 206/37.1
5,740,957 A * 4/1998 Wenkman

FOREIGN PATENT DOCUMENTS

| | | |
|---|---|---|
| DE | 1 043 280 | * 11/1958 |
| DE | 1 962 521 | * 6/1967 |
| DE | 1 147 573 | * 10/1972 |
| DE | 87 00 925 | * 4/1987 |
| DE | 89 02 832 | * 6/1989 |
| DE | 94 20 289 | * 3/1995 |
| FR | 384 766 | * 4/1908 |
| GB | 418 586 | * 10/1934 |
| GB | 1 252 752 | * 11/1971 |

* cited by examiner

*Primary Examiner*—William L. Miller
(74) *Attorney, Agent, or Firm*—Kubovcik & Kubovcik

(57) ABSTRACT

An album page having at least one pair of parallel strips (5), which are joined to a substrate (1) in the longitudinal direction of the strips (5) and, at their mutually facing edges, have an unjoined region. The distance between the longitudinal joins is slightly greater than the extent in one direction of an object (6) to be held. In one embodiment the strips (5) are of the same length as the longitudinal edges of the substrate (1). In this way the album pages can be produced in a continuous process. The album page is preferably produced from the same materials (e.g., cardboard).

5 Claims, 6 Drawing Sheets

ALBUM SHEET

BACKGROUND OF THE INVENTION

1. Field of the Invention

The invention relates to an album page for holding at least one planar object at least on one side, comprising a rectangular substrate, one longitudinal edge of which is designed as a binding edge, and at least one pair of parallel strips, which are joined to the substrate parallel to the longitudinal edges thereof and, at their mutually facing edges, have an unjoined region, the distance between the mutually facing edges of the strips being shorter than the dimension in one direction of the object to be held and the distance between the longitudinal joins which connect a pair of strips to the substrate being slightly greater than in one direction the dimension of the object to be held.

2. Description of the Related Art

Album pages of this kind are known from DE-U 1 962 521 and DE-D 1 043 280.

Album pages of this kind are bound into albums and are used to hold photographs, visiting cards, cheque cards and telephone cards, coins or other planar objects of identical formats.

In the case of the solutions mentioned, the album pages comprise a substrate, preferably a transparent film, which, to form the pockets, is provided with plastic strips which are welded, or adhesively bonded on. The photographs are simply clamped beneath the edges of the strips at two opposite edges. The holding of the objects is thus extremely simple, but a plastic substrate is very flexible and hence is suitable for holding photographs only to a limited extent, and is not suited at all to holding more solid objects. Moreover, it is not very attractive, so that purchasers prefer albums with cardboard pages as the substrate.

A principle reason why a solution of this kind has not been able to gain acceptance is, moreover, the difficulty of producing such album pages. The strips have to be cut in advance and applied individually to the substrate, to which they are then welded.

By contrast, other album pages which are known from DE-U 94 20 289 are technically much easier to produce. They comprise a cardboard substrate which is adhesively bonded to an upper, transparent layer. In this case, however, owing to the different material properties, the influence of changing temperatures and atmospheric humidity can easily lead to creases or to the materials becoming detached.

If the substrate is also chosen to be a film, to which the upper layer is welded, then, despite the fact that a uniform materials system with a durable joining technique is present, there are even more disadvantages than those already outlined above. To be able to label the pages, it is necessary to provide further pockets for extra insertable labelling strips, whereas cardboard pages can be written on directly. Finally, subsequent disposal also represents a problem.

There is therefore a need for album pages which can be produced as far as possible exclusively from cardboard.

Such album pages are known, for example, in the form of cardboard pages which are provided with slots into which the four corners of a photograph can be inserted. However, album pages of this kind can only have photographs on one side, so that only half the number of photographs can be held for the same number of pages as the number which can be accommodated in the album as described above, unless the photographs are arranged offset with respect to one another on the front and rear sides, although this then results in corners which have been inserted into the slots being visible on the respective reverse side. Moreover, the photograph becomes an octagonal picture, so that the visual quality of the photo is reduced when viewing the album.

Album pages in the style of passe-partouts are also known, for example from DE-U 7 147 573, in which a cardboard substrate is adhesively bonded on both sides to in each case a further cardboard page, which is provided with picture cutouts, in such a way as to produce insert pockets for photographs. This solution has the drawback that firstly the picture cutouts have to be punched out, which is technically very complex. Moreover, large quantities of picture-window cutouts which cannot be used are produced.

BRIEF SUMMARY OF THE INVENTION

The invention is based on the object of providing an album page of the type mentioned at the outset which is technically easy to produce and, if desired, allows exclusively cardboard to be used.

According to the invention, the object is achieved by the fact that the strips are of the same length as the longitudinal edges of the substrate.

This measure permits significantly simpler production than that of the known album pages. It is technically easy to produce the album pages in a continuous process. The substrate is drawn off an endless roll and, in the most simple case, may be provided only with longitudinally running lines of glue, to which the strips are applied and adhesively bonded to the substrate. Suitable adhesives are conventional dispersion adhesives or else hot-melt adhesives. This is then followed merely by cutting to form single pages. Moreover, the measure allows exclusively cardboard to be used.

In this case, if a plurality of pairs of strips are provided, the adjacent strips of neighbouring pairs of strips may be combined to form a single strip.

To provide a greater degree of protection against the objects falling out or for heavier objects, it is additionally possible to provide a form fit, in that at least one strip of in each case one pair of strips is joined, at least at its end regions, to the substrate via additional joins in the region of the mutually facing edges, as is already known from DE-U 1 962 521.

Additional joins may be provided in order to fix each individual object, the distance between which joins are matched to the dimensions of the object to be hold. The objects are then fixed immovably on both sides in small pockets. An arrangement of the joins with mirror symmetry is preferably selected in this case.

The objects to be held, i.e. photographs, telephone cards, etc. are simply inserted on both sides into the gap between strip and substrate, where they are clamped in place. The clamping force is sufficient to hold light objects immovably.

DETAILED DESCRIPTION OF THE INVENTION

It is preferred for strips to be applied to both sides of the substrates simultaneously, it also being possible to apply three or more strips to each side in order to form a plurality of adjacent rows for the objects to be held.

For forming the pockets, the pattern of glue may be applied analogously to the intaglio printing process, or optionally also by means of flexographic printing processes, using a printing roller. The separation into individual album pages after the strips have been applied must then in each case take place in such a manner that the same pattern of pockets is always produced.

To form the pockets, glue may also be applied by means of nozzles. In each case one nozzle then continuously applies glue for the longitudinally running lines of glue. The glue for the additional joins running transversely to the direction of movement of the cardboard web is applied by additional nozzles, each of which intermittently applies a spot of glue only at the planned locations. At the locations at which the web is later separated into individual pages, two spots of glue are applied in immediate succession, so that the separation can take place between the two spots of glue and then in each case one spot of glue is located at the end region of one page.

This technique has the advantage that the pattern of glue can easily be varied for different formats, since all that is necessary is to change the timing of the additional nozzles and/or the distance between them.

The strips may preferably consist of the same material as the substrate, or else of a different material, a stiff material which may be of any desired type preferably being used for the substrate. Cardboard or a plastic film is usually suitable for the substrate. If desired, the strips may consist of a thinner material than that of the substrate, in order to keep the thickness of the album within reasonable limits. If it is intended to use the same material for the strips as for the substrate, the strips may also be cut from one or both edges of the substrate web during the production process.

If film is used both as the substrate and for the strips, welding may also be used instead of adhesive bonding.

Special sealable films also allow a form of welding of film and cardboard to be implemented. At the locations at which the film is to be joined to the cardboard, it is heated and joined to the cardboard by means of pressure. Suitable materials for this process are polypropylene or polyethylene and other film materials.

Further suitable joining methods are stapling or press joins of the type which are usual in the production of coffee filter papers.

Preferably, a strip may be laid around the outer longitudinal edge of the substrate. In this way, both sides of the substrate are provided with an edge strip simultaneously, and a neat page edge is produced. However, it is equally preferred for the longitudinal edge also to be provided, in addition, with a folding strip laid around the edge and adhesively bonded or welded on all sides, for example a binding tape, consisting of plastic, as a decorative tape or as edge protection.

On one side of the album page, an edge is left free for bookbinding purposes. Moreover, a strip for writing may be provided, and may optionally also be printed with a pattern of lines or in some other way, this being possible in the continuous printing process. The individual album pages are bound into an album, it also being possible to insert, in the usual way, glassine sheets or clear view films between the album pages.

In order to enable the strips to be gripped from below when inserting photographs or other objects without putting load on the additional joins, it may furthermore be provided for these additional joins to end before the outer border of the respective strip. In this case, it is also possible to differentiate between the joins at the end regions of the strips and the other additional joins, by designing the former to be longer than the latter.

In order not to have to grip the strips from below at all when inserting the objects, it may be provided for the strips to have a broken border or a web, which is folded down towards the substrate, along their mutually facing edges. The broken border is made before the strips are applied to the substrate, by inserting a fold line close to the edges of the strips, on their upper side. The border then curves upwards slightly along this strip edge, so that photographs or other objects slide under the strips when being inserted, without the need to manipulate these strips at all.

Similarly, a web may be folded down before the strips are applied to the substrate. The webs then likewise cause the respective strip edge to curve up.

In both cases, the album pages also have a visually more pleasant appearance at the strip borders.

BRIEF DESCRIPTION OF THE SEVERAL VIEWS OF THE DRAWINGS

The invention will be explained in more detail below with reference to exemplary embodiments. In the appended drawings:

Figure 1:
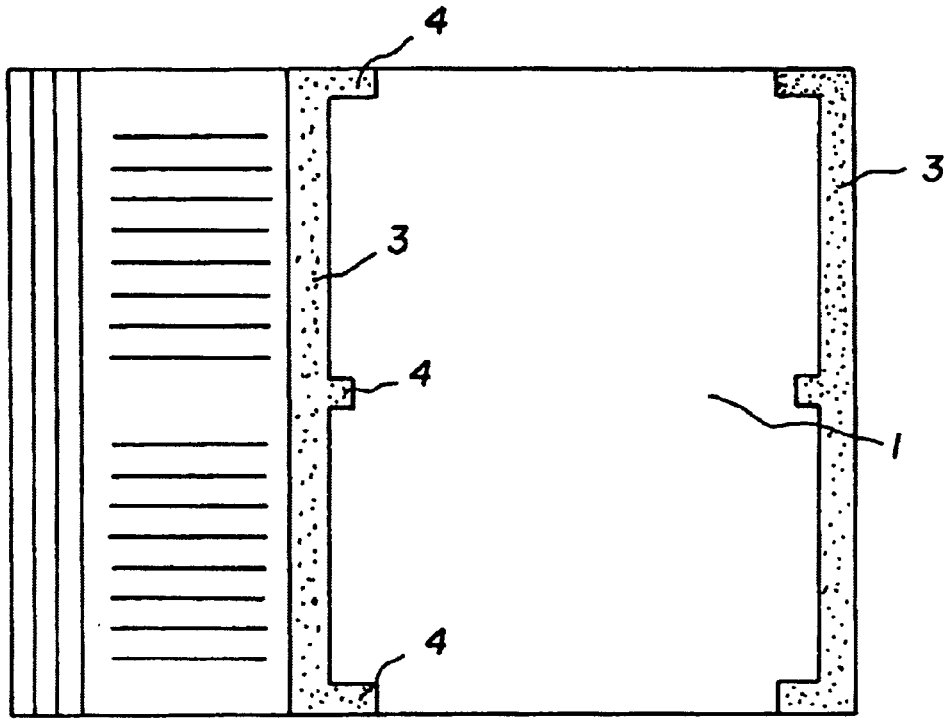
Figure 2:
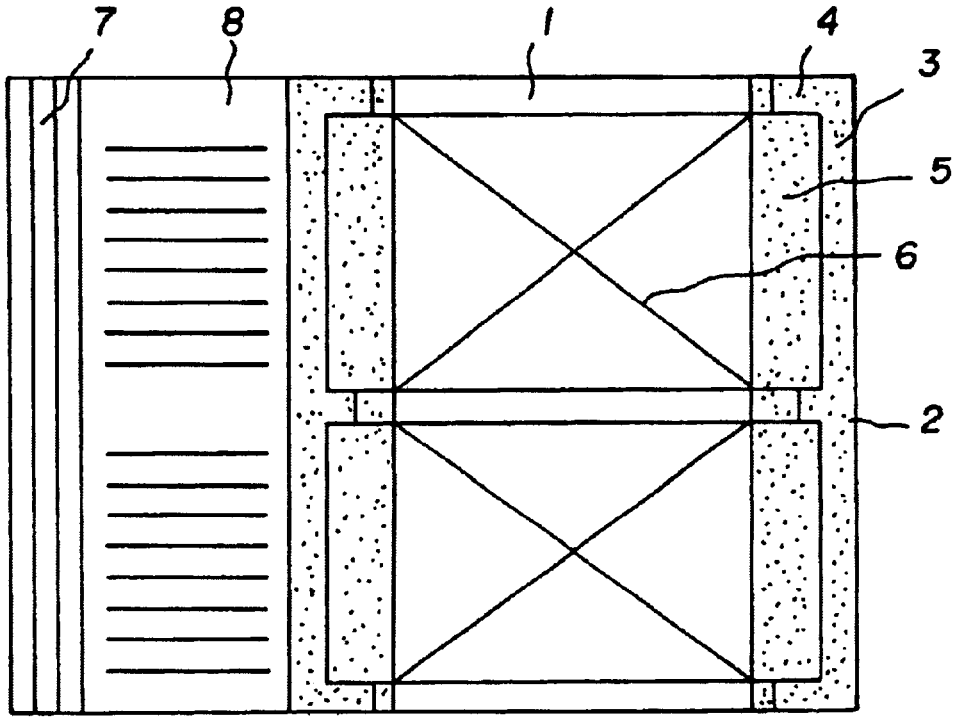
Figure 3:
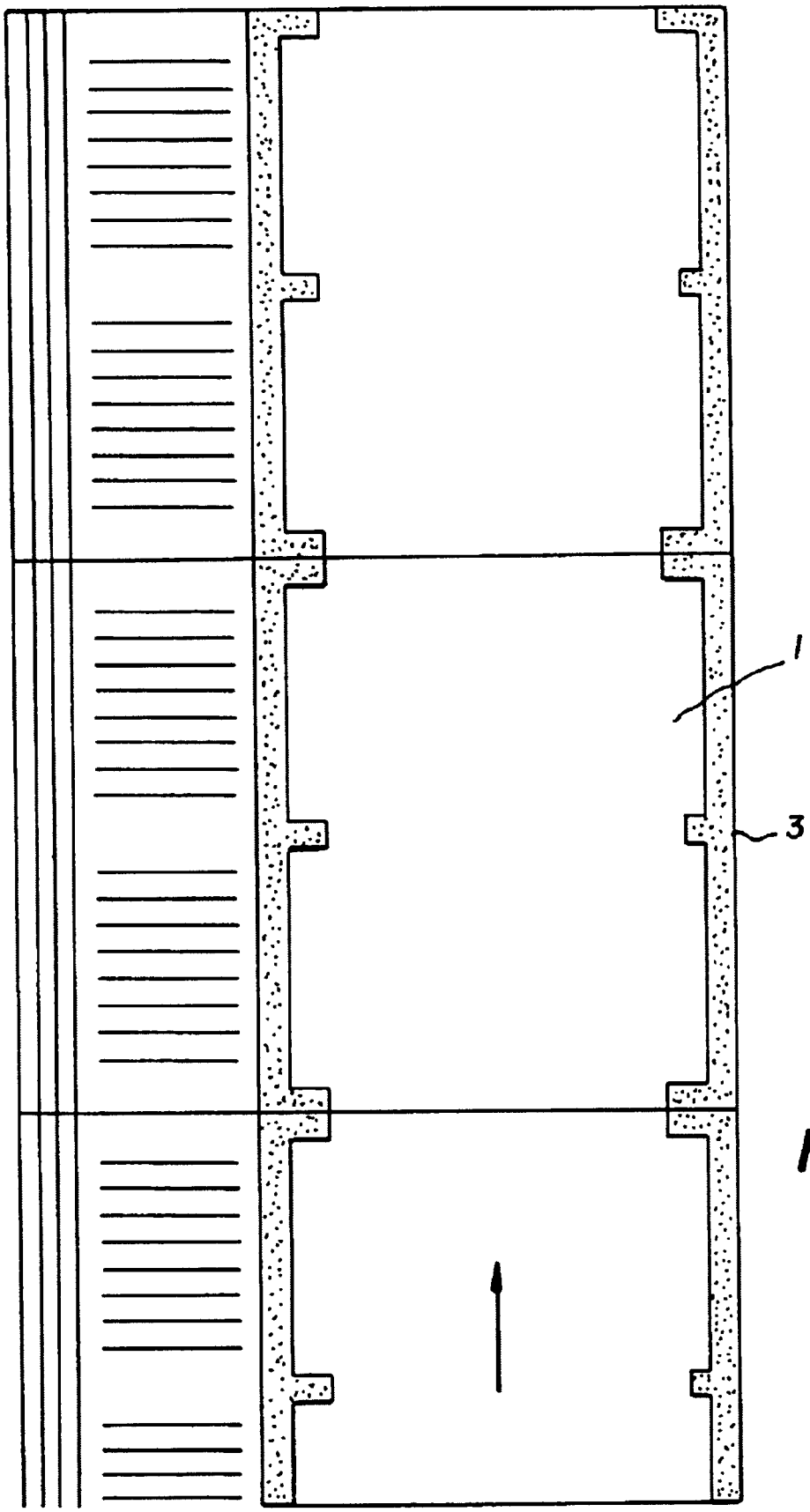
Figure 4:
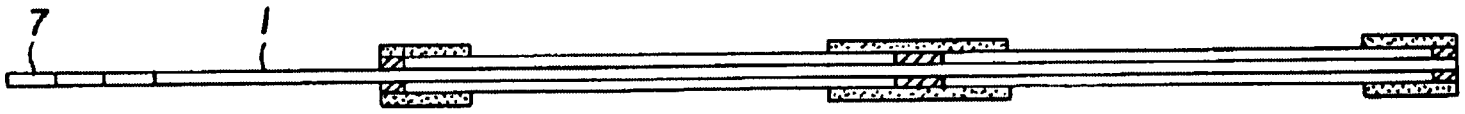
Figure 5:
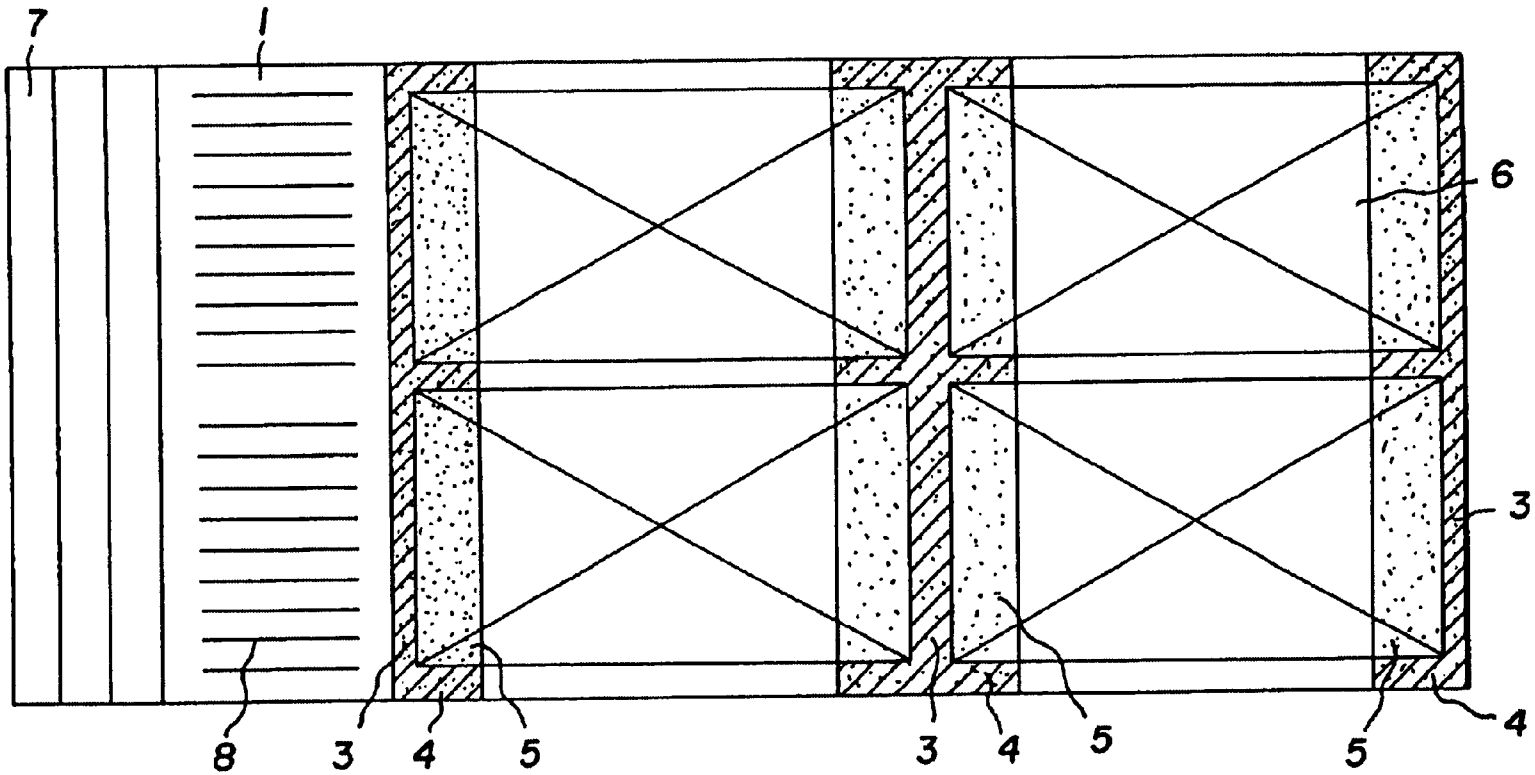

| | |
|---|---|
| FIG. 1 | shows a cardboard substrate of an album page according to the invention with the joins arranged in the form of lines of glue, before the strips are applied, |
| FIG. 2 | shows a finished album page, |
| FIG. 3 | shows a cardboard web, which has already been glued, before the strips are applied and the web is separated into individual album pages, |
| FIG. 4 | shows an exemplary embodiment of an album page which can hold four photographs, in a view towards the bottom edge of the album page, |
| FIG. 5 | shows a plan view of the exemplary embodiment in accordance with FIG. 4, |

Figure 6A:
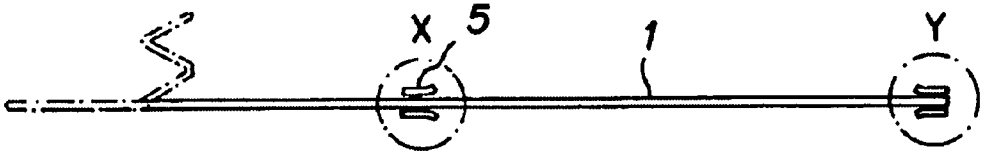
Figure 6C:
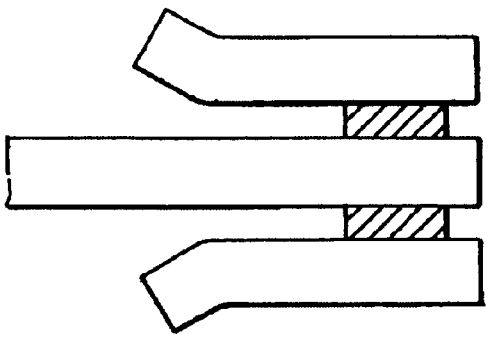
Figure 6B:
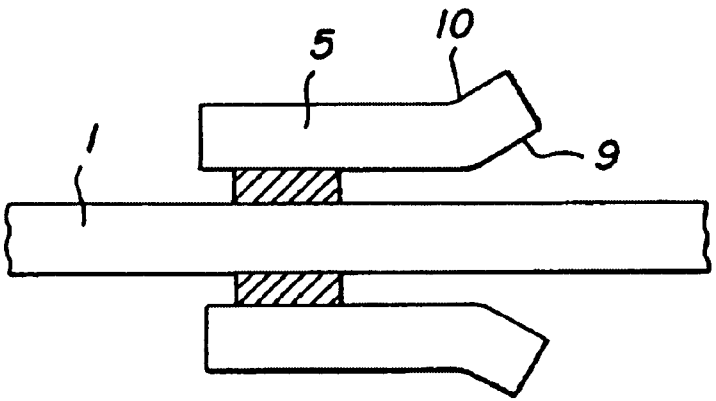
Figure 7A:
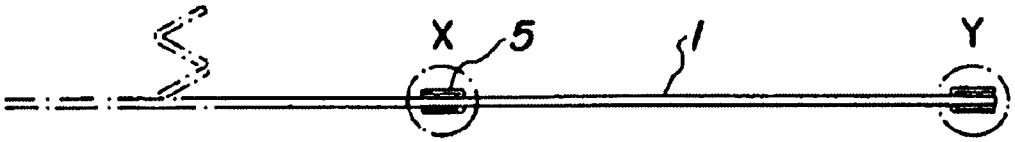
Figure 7C:
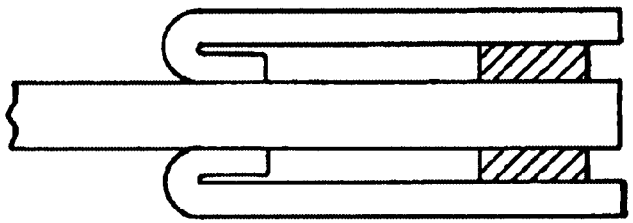
Figure 7B:
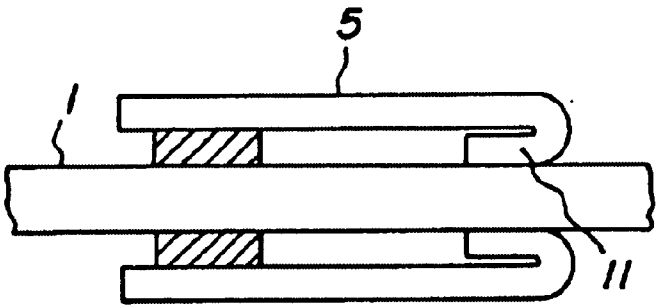

FIGS. 6A, 6B and 6C show an exemplary embodiment of an album page with strips whose mutually facing edges have a broken border, and FIGS. 7A, 7B and 7C show an exemplary embodiment of an album page with strips whose mutually facing edges have a folded-down web.

Figure 8:
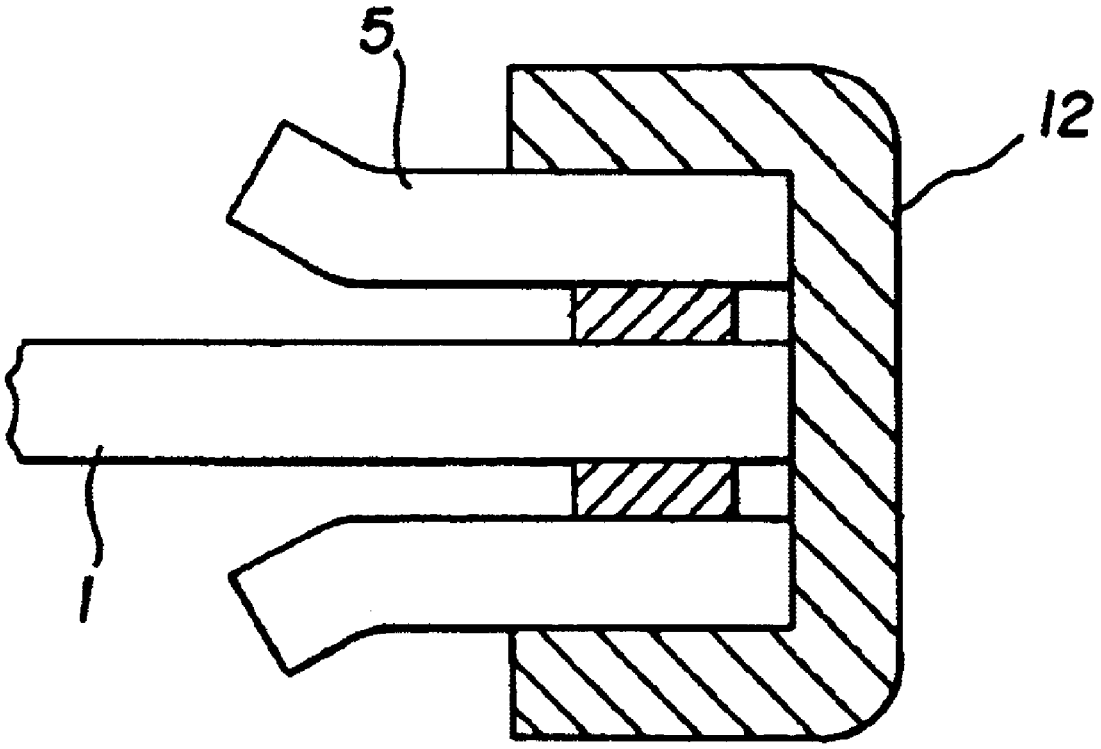

FIG. 8 shows an exemplary embodiment of an album page with a folding strip joined to the substrate and laid around an outer longitudinal edge.

FIG. 1 shows a cardboard substrate 1 of an album page according to the invention, which is glued with two lines of glue 3 along or parallel to the longitudinal edges of the cardboard substrate 1 and, extending from these lines of glue, with additional spots of glue 4, which are directed towards one another.

FIG. 2 shows the finished album page. A strip of paper 5 has been applied to each of the lines of glue 3, forming a joining seam 2. The strip of paper 5 at the outer longitudinal edge of the cardboard substrate 1 may be laid around the edge and adhesively bonded in a similar manner to the rear side. This simultaneously ensures a neat edge to the page. The second strip ends flush with the line of glue 3.

The spots of glue 4 are arranged at an interval which is slightly greater than the width of a photograph 6 to be held, while the distance between the strips of paper 5 is kept such that it is slightly shorter than the length of the photograph 6. This forms two pockets which face one another and together provide an insertion pocket. The sides of the photographs 6 are slid into the pockets, where they are then fixed immovably in all directions.

The length of the spots of glue 4 is shorter than the width of the strips of paper 5, in order to allow the strips of paper 5 to be gripped from below when inserting the photographs 6 and in order not to place a load on the adhesive edges of the spots of glue 4 when doing so. In order to fix the strips of paper 5 firmly at the upper and lower transverse edges of the album page, however, the spots of glue 4 at those edges are made slightly longer than the other spots of glue in the centre of the album page.

An edge 7, which in the present case is provided with fold lines, is left free for bookbinding purposes towards the inner edge of the cardboard substrate 1. Moreover, a strip for writing 8 with preprinted lines is provided. Instead of the lines, it would also be possible to print on other labels or graphic images.

The area for the photographs 6, which is shown only diagrammatically in FIGS. 1 and 2, may actually be kept much larger, since only very small pockets are required for fastening at the sides, these pockets shortening only to an insignificant extent the picture area which can be seen at the sides.

FIG. 3 shows the cardboard substrate 1 in the production phase of the album page. The cardboard is drawn off a roll as an endless material in the direction of the arrow and the lines of glue 3 are applied by a process similar to intaglio printing or by means of nozzles. Moreover, in a subsequent or previous process step, the strip for writing 8 is printed and the fold lines are made at the edge 7. The strips of paper 5 to be applied to the lines of glue 3 are likewise present as endless material. They are guided flush above the lines of glue 3 and are joined to the cardboard substrate by means of pressure rollers, so as to form join seams 2. The strip of paper 5 at the outer edge of the cardboard substrate 1 may also, as stated above, be folded around the edge of the cardboard substrate 1 and then adhesively bonded to the latter.

After the strips of paper 5 have been adhesively bonded, it only remains to separate the web into individual album pages. FIG. 3 diagrammatically indicates the subsequent cut lines, which are not visible as such.

FIGS. 4 and 5 show two views of an album page for four photographs 6. To produce such an album page, three strips of paper 5 are applied to the cardboard substrate 1, the line of glue 3 for the central strip of paper 5 then running centrally.

FIGS. 6A, 6B and 6C show a further improvement with regard to handling and visual aspects. It can be seen in particular from the enlarged representations (FIGS. 6B and 6C) that the borders 9 of the strips of paper 5 are broken and as a result point slightly upwards. The break is produced by making a fold line 10 before the strips of paper 5 are adhesively bonded to the cardboard substrate 1. During insertion, the objects to be held then slide beneath the strip edge of their own accord.

FIGS. 7A, 7B and 7C show a variant of this measure which achieves the same effect. A web 11 is folded down at the mutually facing edges of the strips of paper 5 before the latter are adhesively bonded to the cardboard substrate 1. The web 11 causes the strips of paper 5 to have rounded borders, which moreover stand slightly raised, so that the objects to be introduced slide beneath the borders without it being necessary to grip the strip edges from below.

FIG. 8 shows an improvement where a folding strip 12 such as a binding tape is laid around a longitudinal edge of the substrate and joined to the substrate via the strip 5 to provide a decorative edge or as edge protection.

What is claimed is:

1. An album page for holding at least one planar object at least on one side, comprising a rectangular substrate having two longitudinal edges, one longitudinal edge of which is a binding edge; at least one pair of parallel strips, which (1) are of the same length as the longitudinal edges of the substrate, (2) are joined to the substrate parallel to the longitudinal edges thereof and (3), at their mutually facing edges, have an unjoined region; and a pair of longitudinal joins which join each of said at least one pair of parallel strips to the substrate by adhesive bonding; characterized in that said substrate and said at least one pair of parallel strips consist of cardboard, said at least one pair of parallel strips have, along said unjoined regions, a border which is bent upwards by means of a fold line formed on a surface of the strips parallel to said longitudinal edges, and at least one strip of each pair of said at least one pair of parallel strips is joined, at least at its end regions, to the substrate via additional joins extending from one of the longitudinal joins that joins said strip to the substrate toward the border of said at least one strip and the length of said additional joins at said end regions of said at least one strip is greater than that of an intermediate additional join that joins an intermediate portion of said at least one strip to the substrate.

2. An album page according to claim 1, characterized in that a plurality of said at least one pair of parallel strips are provided and adjacent strips of said plurality of said at least one pair of parallel strips are combined to form a single strip.

3. An album page according to claim 1, characterized in that a folding strip is joined to the substrate and is laid around an outer longitudinal edge of said two longitudinal edges of the substrate.

4. An album page for holding at least one planar object at least on one side, comprising a rectangular substrate having two longitudinal edges, one longitudinal edge of which is a binding edge; at least one pair of parallel strips, which (1) are of the same length as the longitudinal edges of the substrate, (2) are joined to the substrate parallel to the longitudinal edges thereof and (3), at their mutually facing edges, have an unjoined region; and a pair of longitudinal joins which join each of said at least one pair of parallel strips to the substrate by adhesive bonding; characterized in that said substrate and said at least one pair of parallel strips consist of cardboard, a plurality of said at least one pair of parallel strips are provided and adjacent strips of said plurality of said at least one pair of parallel strips are combined to form a single strip, said at least one pair of parallel strips have, along said unjoined regions, a border which is bent upwards by means of a fold line formed on a surface of the strips parallel to said longitudinal edges, and at least one strip of each pair of said at least one pair of parallel strips is joined, at least at its end regions, to the substrate via additional joins extending from one of the longitudinal joins that joins said strip to the substrate toward the border of said at least one strip and the length of said additional joins at said end regions of said at least one strip is greater than that of an intermediate additional join that joins an intermediate portion of said at least one strip to the substrate.

5. An album page according to claim 4, characterized in that a folding strip is joined to the substrate and is laid around an outer longitudinal edge of said two longitudinal edges of the substrate.

* * * * *